US005592721A

United States Patent [19]

Zeller

[11] Patent Number: 5,592,721

[45] Date of Patent: Jan. 14, 1997

[54] HOLDER TO SECURE SHEET MATERIAL

[76] Inventor: Hal M. Zeller, 824 Loda La., Cincinnati, Ohio 45245

[21] Appl. No.: 500,605

[22] Filed: Jul. 11, 1995

[51] Int. Cl.[6] ..... A41F 1/00; A44B 21/00

[52] U.S. Cl. ..... 24/460; 24/67 R; 24/461; 24/115 L

[58] Field of Search ..... 24/67 R, 460, 24/461, 522, 593, 462, 115 L, 136 A, 716; 160/DIG. 6, 346, 347; 211/50, 89

[56] References Cited

U.S. PATENT DOCUMENTS

| | | | |
|---|---|---|---|
| 316,062 | 4/1885 | Riessner | 211/89 |
| 2,210,214 | 8/1940 | Noll | 24/522 |
| 2,377,488 | 6/1945 | Fugazzi | 24/461 |
| 2,866,249 | 12/1958 | Normandin | 24/460 |
| 3,168,954 | 2/1965 | Von Herrmann | 211/50 |
| 3,205,547 | 9/1965 | Riekse | 24/462 |
| 3,517,420 | 6/1970 | Anzini | 24/136 A |
| 3,591,013 | 7/1971 | Von Herrmann | 211/50 |
| 3,675,782 | 7/1972 | Dudley | 211/50 |
| 3,984,081 | 10/1976 | Hoganson | 24/115 L |
| 4,085,848 | 4/1978 | Tsuge | 211/89 |
| 4,277,903 | 7/1981 | Crossot | 40/152 |
| 4,445,969 | 6/1984 | Huth | 223/96 |
| 4,641,756 | 2/1987 | Brown | 211/89 |
| 4,682,618 | 7/1987 | Zwick | 24/461 |
| 4,762,318 | 8/1988 | Phillips et al. | 24/115 L |
| 4,852,845 | 8/1989 | Lener | 24/460 |
| 5,117,598 | 6/1992 | Livingston et al. | 52/222 |
| 5,170,982 | 12/1992 | Schultheis | 248/316.3 |

FOREIGN PATENT DOCUMENTS

| | | | |
|---|---|---|---|
| 0658961 | 5/1965 | Belgium | 24/67 R |
| 0892891 | 5/1944 | France | 24/67 R |
| 1286849 | 1/1962 | France | 24/462 |
| 1080924 | 4/1960 | Germany | 24/460 |
| 0569050 | 11/1957 | Italy | 24/460 |

OTHER PUBLICATIONS

Way Out West Rug Hugger & Quiltkeeper Sales advertisment enclosed P.O. Box 3094 Carlsbad, Ca. 92009 1-800-326-8479.

Art-in-a-Pinch Quilt Hangers Sales Advertisment enclosed 7738 Davenport Road Princton, Mn 55371 1-612-369-4500.

*Primary Examiner*—Victor N. Sakran
*Attorney, Agent, or Firm*—Charles R. Wilson

[57] ABSTRACT

A holder for flexible sheet material providing a substantially horizontally oriented housing containing convergent parallel walls forming an interior passageway with an opening. Contained within the housings' passageway are several spaced cylindrical rods with removable handles attached and exposed through the opening of the housing. The relationship between the diameter of the rods and the opening between the convergent walls is such that the rods can not pass through the opening and exit the housing. Sheet material moved into the opening in an upward direction between the inside front of the housing and the rods is secured by pulling on the handles attached to the rods to activate the wedging action. The sheet material can be removed from the holder by moving the handles vertically within the passageway to allow the sheet material to slip freely out of the housing. The maneuverability of these wedging rods via the affixed handles permits it to be used to secure sheet materials of various thickness, weights and textures.

16 Claims, 4 Drawing Sheets

FIG. 1
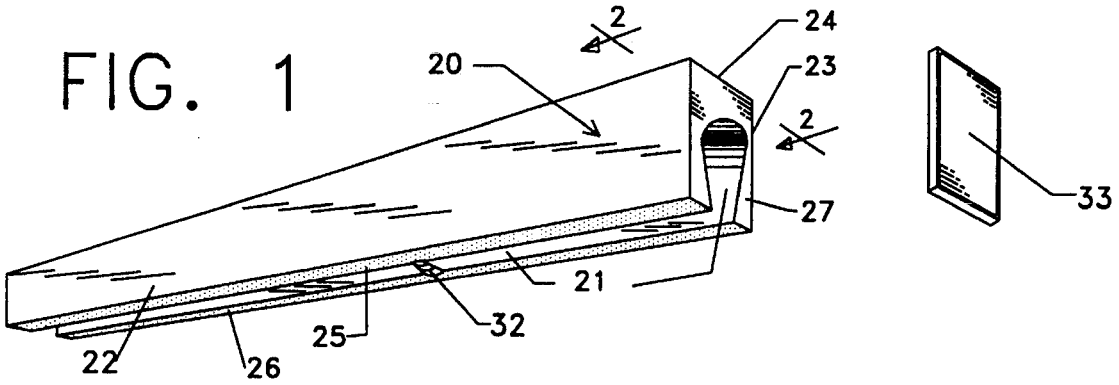
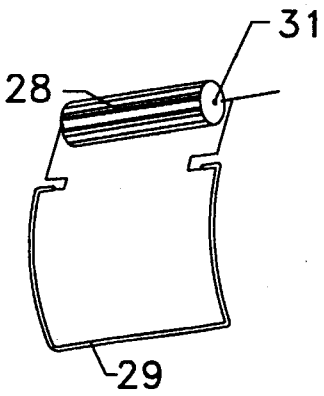
FIG.3
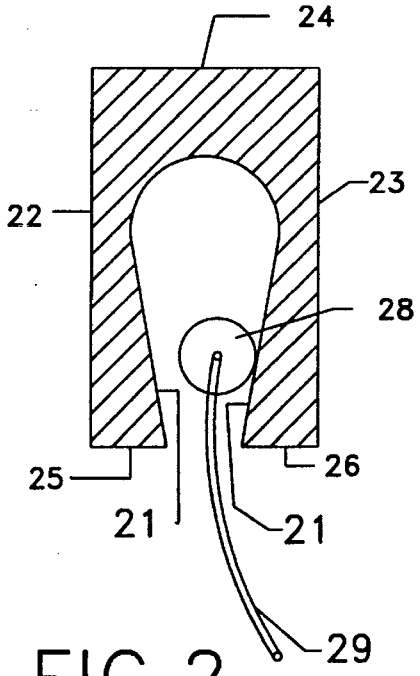
FIG.2

HOLDER TO SECURE SHEET MATERIAL

BACKGROUND —FIELD OF INVENTION

This invention relates generally to a holder for securing flexible rectangular sheet materials of varying thickness, weight and composition particularly to such a holder that can support sheets of fabric art such as quilts, tapestries, rugs, blankets, cloth banners, flags and similar objects for display in a generally vertical manner.

BACKGROUND —DESCRIPTION OF PRIOR ART

Various devices have been developed to temporarily hold flexible sheet material. These devices operate primarily by inserting the sheet to be held upward into the hanger housing to displace a moveable body and then released to be Dulled down by gravity to wedge the sheet between the housings' internal passageway walls and the moveable body.

One such invention is disclosed in Pieter Von Herrmanns' U.S. Pat. No. 3,591,013 Issued Jul. 6, 1971 which disclosed improvements to his earlier U.S. Pat. No. 3,168,954. The improvements included the addition of a protruding lip that prevents improper insertion of the sheets which are to be supported by the device. It is obvious from this design that the sheets are always to be held near the rear of the hanger, that is between the roller and the back face of the hanger. This leaves the rollers exposed to anyone looking at the sheets which is unacceptable for some applications. Mr. Herrmann discloses in his patent that the sheets are to be of a rigid nature such as charts, drawings, notices and photographs. This type of device could not be used to hold a more flexible sheet material of the composition such as fabric since the rigidity of the sheet is relied upon to displace the wedging means. There is no means in the previously mentioned invention to guide the sheet material into the hanger or to adjust tension, alignment or waviness of the sheet material being supported. Mr. Herrmanns' design has the protruding lip to allow for the quick release of the sheets being held in the hanger. By grasping the sheet material and then pulling up and out the sheet slips out of the hanger. In many applications this is an undesirable situation. A large sheet of material can be quite heavy and it is undesirable to have it become disconnected by someone pulling on it.

A similar hanger for sheet material is disclosed in James M. Dudleys' U.S. Pat. No. 3,675,782 issue Jul. 11, 1972. Mr. Dudley uses rollers or balls to clamp the sheet between the roller and the rear face of the hanger housing. His patent includes a method of interconnecting the balls or rollers with a string, wire or chain. This is to assist with the release of the sheet. In addition to the means of interconnecting the rollers or balls Mr. Dudley includes an electromagnetic system for releasing the sheet from the hanger. This creates a much more complex and expensive device and limits where the hanger may be used.

The hanging of sheet material of the composition such as fabric sheet material in a gravity activated hanger is disclosed in U.S. Pat. No. 5,170,982 dated Dec. 15, 1992 by Gerald A. and Debra A. Schultheis. The invention utilizes a method of using a sphere to provide the securing wedging action upon the sheet material. This method discloses a means to use only one spherical unit contained between two vertically oriented members to form a curvilinear surface with a slot opening to accept and hold sheet material that is inserted. The main advantage of this unit is that it allows one handed insertion and removal of the object to be supported. There is a problem with supporting fabric from this type of hanger in that the fabric tends to sag, drape or wave as it hangs from one securing sphere.

This may be acceptable for towels or other small objects that can be allowed to drape down freely. However, the configuration of this device limits its weight carrying capacity, size restrictions and appearance of the sheet being supported. This device relies principally on the mass of the sphere and its natural reaction to gravity to activate the securing wedging action and it offers no adjustments if insufficient friction exists to activate securing wedging action. Mr. and Ms. Schultheis state within their patent that a rod-type fastening hanger requires a certain amount of rigidity in the sheet material to allow that material to move the rod(s) upward in its fastening channel and to cause the release of the sheet material.

There are commercially available devices that clamp the sheet between two pieces of wood which are clamped together using machine threads. Way Out West at post office box 3094 Carlsbad, Calif. 92009 offers one product for sale that uses wooden threads to perform the clamping action to secure the sheet material. Another device is for sale by Art-in-a-Pinch at 7738 Davenport Road Princeton, Mont. 55371 that is the same type of device differing in the clamping threads used here are of the metal composition. There are several disadvantages to this type of device. There are obvious weight limitations with this clamping type hanger and the sheet is easily pulled out of the hanger. It is also unlikely that this type of device will allow the hanging of more than one sheet object with varying thickness from the same unit. This type of hanger also leaves the clamping hardware exposed to view from the front that is sometimes undesirable.

There are several other methods that hold the types of sheet materials that I have discussed. The most common method requires the alteration of the sheet material either by sewing or otherwise fastening a sleeve to the top horizontal edge of the sheet. This sleeve can then receive a rod to provide horizontal support. This supporting member will usually extend slightly beyond the fabric edges to provide a means to attach to a supporting bracket.

The invention described herein overcomes the problems discussed above and will disclose features that provide new options for displaying sheet materials.

OBJECTS AND ADVANTAGES

Accordingly, one advantage of my invention is to provide a holder that can reliably secure sheet material of considerable dimension and weight by using handles that will vary the holding capacity beyond that provided by gravity induced friction.

Another object of this invention is to provide an easy-to-use holder that requires no alterations to the sheet material being secured. This advantage provides new alternatives for retailers, collectors, makers, admirers, interior design professionals, home decorators or anyone choosing to hang similar sheet material for display.

Another object of this invention is to provide a quick and easy method for displaying sheet materials, as required in retail display of tapestries, rugs, quilts and other sheet materials where individualized viewing is desirable. This invention makes it easy to rapidly display a piece of sheet material for viewing and customer selection.

Another object of this invention is the ability to hold a plurality of sheets of varying thickness within one housing.

Another object of this invention is to provide a safe method of securing sheet materials for display.

Another object of this invention is to provide a simple housing for sheet material in rooms for acoustical advantages.

Another object of this invention is to increase versatility of displays by making rapid sheet changes possible.

Another object of this invention is to provide a resistance-free insertion of the sheet material by the use of handles that move the rollers in the vertical plane.

Another object of this invention is to provide a guide for the insertion of the sheet material with a series of protruding handles that direct the sheet material into the proper location for mounting.

Another object of this invention is to provide a manually activated stretcher by using an inverted housing secured to the bottom edge of the sheet material which when suspended from the hanging sheet will stretch and flatten the sheet material for display.

Another object of this invention is to provide a section or continuous perimeter housing that will permit the use of fabric sheet material used as a border or other configuration for interior rooms. This invention offers the advantage of being less permanent than paper borders and thus more easily changed. Applications of sheet material to walls or other vertical surfaces provide additional texture to flat surfaces, as well as offering pattern matches with upholstered fabric covers, bedspreads, curtains, drapes and other fabrics.

Another object of this invention is to provide a section or continuous housing attached to countertops for accepting sheet materials such as decorative fabric skirts or towels in areas such as kitchens and bathrooms.

Another object of this invention is the infinite possibilities of configurations that the housing offers in decorating and furniture.

Another object of this invention is to provide a protective ledge from settling airborne dust particles for the upper oriented border of the sheet material being displayed.

Still more objects and advantages will become apparent from a consideration of the following specifications and accompanying drawings.

DESCRIPTION OF DRAWINGS

FIG. 1 is a perspective view of housing 20 consisting of 21, 22, 23, 24, 25, 26, 27 and optional 33.

FIG. 2 is a sectional view of housing 20 taken along line 2—2 of FIG. 1.

FIG. 3 is an exploded pictorial view of rod 28 and handle 29 prior to assembly.

SUMMARY

Briefly stated, the invention is practiced by providing an elongated member with converging front and rear walls to form an internal passageway. These walls spaced from one another to leave an open mouth for the insertion of flexible sheet material. A plurality of wedging pieces rests between the walls of the passageway prior to sheet material insertion. The handles protrude through the opening of the passageway to serve as guides for the insertion of the sheet material to obtain its proper securing position. The wedging pieces are independently functioning and the handles are used to maneuver and activate the securing wedging action by applying additional pressure to the handles. While vertical movement of the wedging pieces in one direction allows zero resistance to the material being inserted, movement in the opposite direction provides the force necessary to securely hold a variety of materials regardless of the surface texture and material thickness.

DESCRIPTION OF INVENTION

Figure 5:
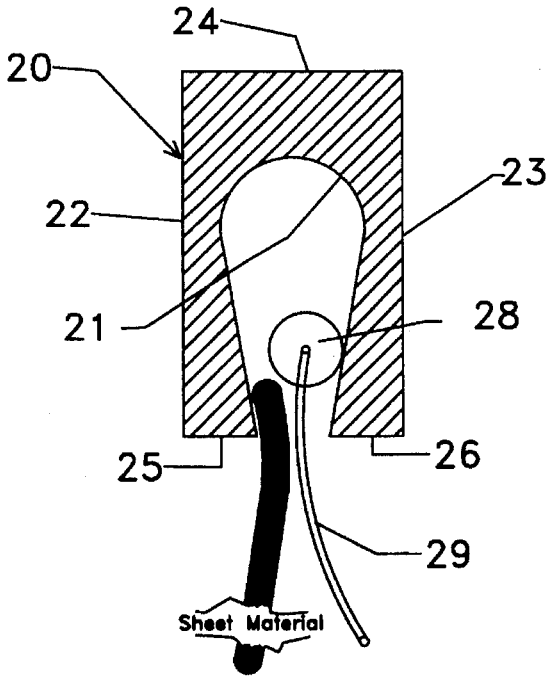
FIG. 5 is a sectional view of housing 20 taken from FIG. 4 at line 5—5 with rod 28 and handle 29 shown in lifted position for insertion of sheet material and prior to engagement of rod 28 for securing.

One embodiment of my invention is shown in FIG. 1 of the drawing, the holder comprises a housing 20 which is an elongated member with two convergent parallel walls which form an internal longitudinal passageway 21 as indicated in FIG. 2. Housing 20 can be constructed from a variety of materials and methods, but the preferred embodiment is to use wood. Housing 20 has substantial thickness to permit an inside passageway 21 of sloped sides as shown in FIG. 1 and FIG. 3. As seen in FIG. 2, adequate distance must be allowed between a face edge 25 and a rear edge 26 to accommodate the thickness of the sheet material to be inserted, in order to function properly this distance must not exceed the diameter of rod 28 as shown in FIG. 2 and FIG. 5. As seen in FIG. 1 an angled notch 32 is cut into face edge 25 and or rear edge 26 to allow insertion and removal of rods 28, the width of this notch is to be approximately equal to the diameter of rod 28. FIG. 1 also shows an end plate 33 for attaching to the end of housing 20 to cover passageway 21. FIG. 2 shows a cross-sectional view of housing 20, it is comprised of a generally rectangular overall shape as defined by a front 22, a top 24, a rear 23 and strategically spaced face edge 25 and rear edge 26. Also from FIG. 2 illustrated in a cross section of housing 20 the passageway 21 is typically cut at an angle of approximately 11 degrees off vertical with a smooth radius at the top to enhance adjustment of rod 28 within passageway 21.

Figure 4:
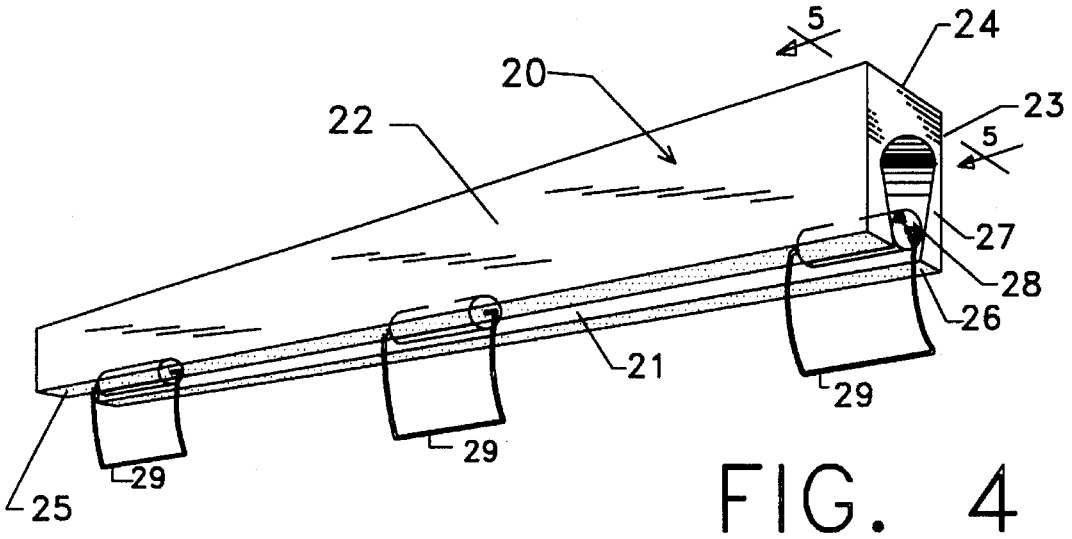
FIG. 4 is a pictorial view of housing 20 with rods 28 and corresponding handles 29 assembled and horizontally positioned in housing 20.
Figure 6:
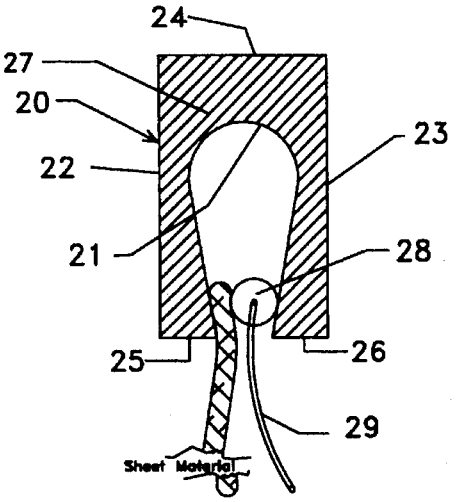
FIG. 6 is a cross section of housing 20 taken at line 5—5 in FIG. 4 showing imposed sheet material secured with assembled rod 28 and handle 29.

Referring now to FIG. 4 the assembled holder shown comprising housing 20 and a plurality of randomly spaced rods 28 with removable handles 29 in position to secure sheet material. Rods 28 provide the necessary wedging force to support the sheet material within housing 20, while handles 29 allow rods 28 vertically movement to allow insertion of the sheet material. FIG. 3 shows exploded sub-assembly of rod 28 and handle 29. A hole 31 bored into the approximate center of rod 28 to allow easy insertion and removal of handle 29 as desired. Handles 29 offer controlled access and maneuverability of rods 28 through the opening in the between face edge 25 and rear edge 26 in housing 20 as seen in FIG. 5 and FIG. 6. As seen in FIG. 6 rod 28 can be used to consistently wedge the sheet material into housing 20 by application of force on handle 29 in the proper direction. This assures entrapment of the sheet material without relying solely on gravity and friction to activate the mechanism.

Figure 8:
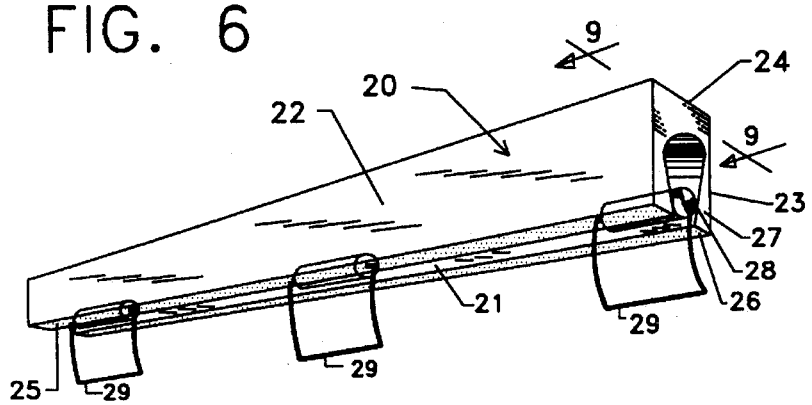
FIG. 8 is a pictorial view of housing 20 for hanging sheet material and a second housing 20 for stretching sheet material, rods 28 shown in elevated position without sheet material inserted.
Figure 8:
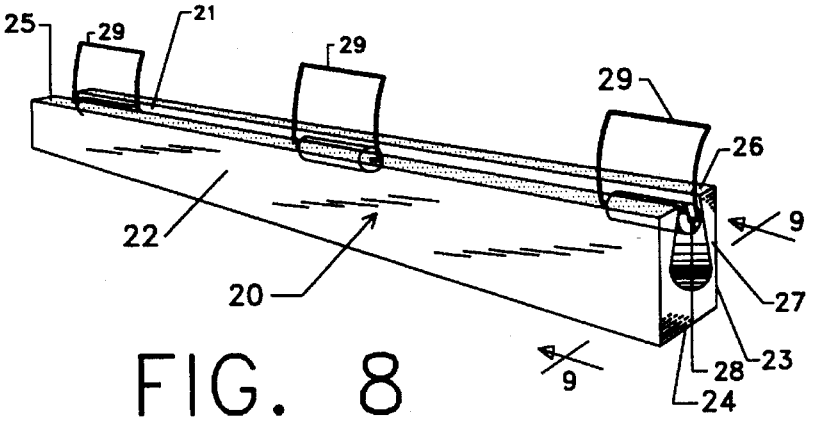
Figure 9:
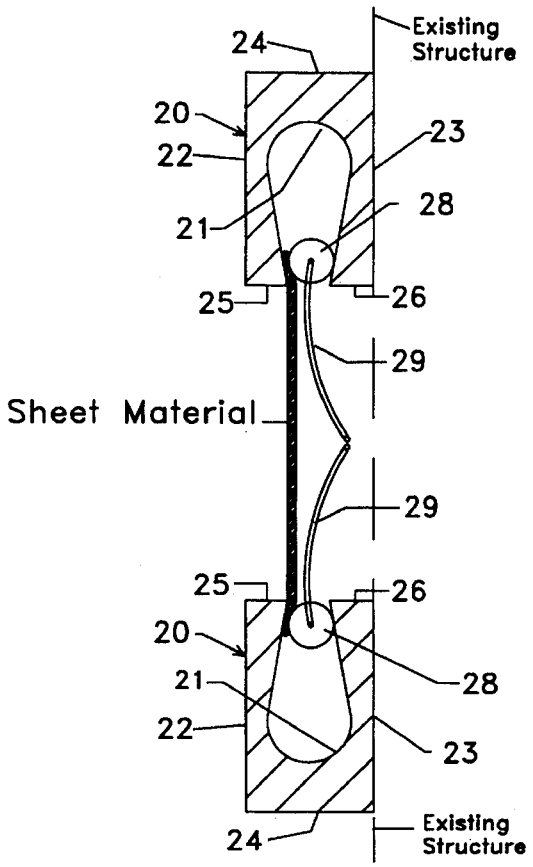
FIG. 9 is a cross section view taken at line 9—9 from FIG. 8 with section of sheet material imposed and secured in housing 20 as hanger and a second housing 20 secured as a stretcher, top housings 20 is attached to an existing surface to support the entire assembly while bottom housing can be supported from the secured sheet or also attached to a surface.

In addition to mounting housing 20 as a hanger, a second housing 20 inverted to be used as shown in FIG. 8 and FIG. 9 as a stretcher. The sheet material inserted into a mounted top housing 20 after the sheet materials' bottom oriented edge is inserted and aligned into the bottom housing 20 using rods 28 and handles 29 to activate the securing action. This bottom assembly can then be supported from the sheet material secured from above to stretch and display the sheet material. The bottom housing 20 can remain free from mounting to hang while causing the sheet material to be controlled from draping or waving. FIG. 9 shows this combination arrangement in use with sheet material secured from within top housing 20 along the top oriented border of the sheet material and also secured along the sheets' bottom oriented border within the bottom housing 20 also attached to the existing vertical surface.

Figure 7:
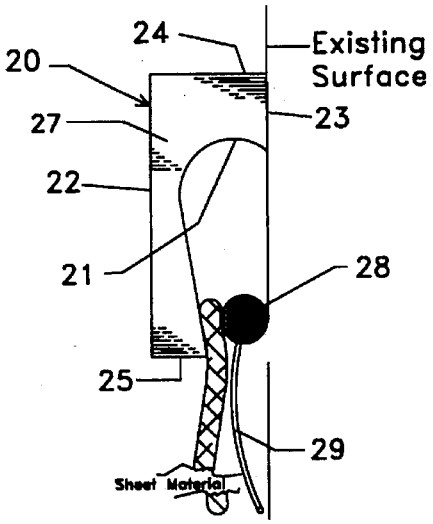
FIG. 7 is a cross section of a modified embodiment showing housing 20 utilizing an existing vertical surface to trap rod 28 within passageway 21.

Another embodiment of my invention is illustrated in FIG. 7. This particular embodiment shown with a modified housing 20 being used against a typically vertical surface to form a passageway 21 to encase the sheet material using rod 28 and handle 29 as previously discussed. The advantage of this type of configuration is the size of the material required is smaller which is obviously a cost advantage and also the secured sheet material is closer to the mounting surface than with the previous embodiment.

Figure 10:
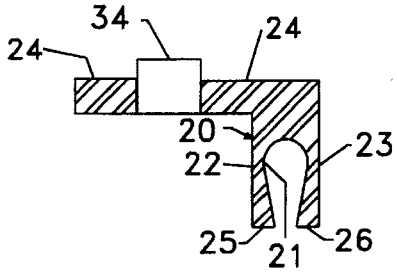
FIG. 10 is a cross-section view of housing 20 with the addition of a housing to accept an illumination source 34 for improved viewing of the sheet material being displayed in housing 20.

Another embodiment of my invention is illustrated in FIG. 10. This particular embodiment is a modification to the housings' top 24 to provide a support means for an illumination source 34 however this source is commonly available and is not a consideration to this invention. With an illumination source mounted to this surface and properly positioned it provides the increases the illumination of the sheet material displayed in the holder.

Figure 11:
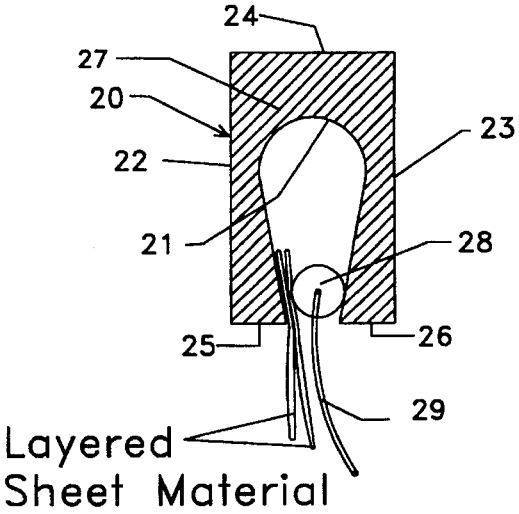
FIG. 11 is a cross sectional view of housing 20 with imposed layered sheet material secured with the assembled rod 28 and handle 29 as in the application of hanging skirts and trousers from their edges.

The securing of multiple layers of sheet material such as the aligned cuffs of a pair of trousers shown in FIG. 11.

OPERATION OF INVENTION

Having described my invention its use and function may be better understood from the following description of the operations for its use.

Firstly, a holder formed according to the foregoing specification and as illustrated in the accompanying drawings. The rear face 23 is typically mounted on a supporting structure in a substantially vertical orientation. The device may be fastened to the surface using any known mechanical means to maintain its mounted position.

Once mounted, my holder is used by manually moving a piece of sheet material upwardly within housing 20 and in front of rods 28. Rods 28 are moved vertically upward by using handles 29 to allow easy insertion of the sheet material, rods 28 are then moved downward to wedge the sheet material between housing 20 and rods 29. The handles 29 allow easy adjustment of the wedging force applied to the sheet material to allow for weight and surface texture variations of the sheet material being supported. The use of handles 29 provide controlled gripping capabilities of the sheet material within housing 20 that gives my invention the ability to hold heavy sheet materials without fear of slippage. The handles 29 also allow easy adjustment of the straightness and flatness of the sheet material being displayed. The sheet material can be removed from the holder by using handles 29 to release the pressure simply by moving them in the proper vertical direction, which allows the material to easily slip out of housing 20. The handles 29 can provide increased holding capacity by applying addition force to activate the wedging action necessary to secure certain sheet material. Once the sheet material is properly secured the rods 28 and handles 29 are hidden from view by the sheet material.

It is to be further noted from the structure specified that there is no particular theoretical limit to the thickness of material that might be held in my holder nor generally to the size of such materials, but again there are practical limits. My holder is designed primarily for fabric-like sheet material such as quilts, tapestries, rugs, throws, blankets, cloth banners, flags and similar objects for display in a generally vertical manner.

The foregoing description of my invention is necessarily of a detailed nature so that a specific embodiment might be set forth as required, but various modifications of detail, rearrangement and multiplication of parts might be resorted to without departing from its spirit, essence, or scope.

Having thusly described my invention, what I desire to protect by Letters Patent, and what I claim is:

1. A holder for holding a flexible sheet material in a generally vertical manner on a wall, said holder comprising:

(a) an elongated substantially horizontally oriented housing for mounting on the wall, said housing having an open sided passageway extending the length of the elongated housing, further wherein the passageway has inwardly sloping walls to form a narrowed opening sufficiently wide to receive an edge of the flexible sheet material; and (b) a wedging means positioned in an interior of the passageway of the elongated housing to frictionally hold the sheet material against one of the walls of the passageway, said wedging means dimensioned to freely fit into the interior of the passageway but unable to pass through the narrowed opening of the passageway and further having a handle connected to said wedging means so as to extends through the narrowed opening of the passageway alongside the flexible sheet material when the wedging means is positioned in the passagway, said handle for grasping so as to cause vertical movement of the wedging means within the passageway.

2. The holder as defined in claim 1, wherein said wedging means comprise cylindrical rods with approximately centered bored holes to affix said handle means.

3. The holder as defined in claim 1, wherein the handle means are formed of substantially wire material to be fitted into predetermined holes within said wedging means.

4. The holder as defined in claim 1, wherein the housing includes an open end, a means for closing said open end to enhance appearance while prohibiting outward movement of entrapped said wedging means.

5. The holder as defined in claim 1, wherein said housing means comprises an angled notch in bottom opening edge to permit controlled passage of said wedging means using the attached said handle means through the notch into effective alignment relative to one another longitudinally spaced within said internal passageway.

6. The holder as defined in claim 1, wherein the housing is used to secure the edges of two or more layers of sheet materials simultaneously.

7. The holder as defined in claim 1, wherein the housings' face provides the means to support an illuminating source.

8. The holder as defined in claim 1, wherein the housing comprises the internal passageway with only one angular convergent wall while maintaining space to utilize existing vertical surface for opposing passageway wall.

9. The holder as defined in claim 1, wherein the housing is constructed of wood.

10. The holder as defined in claim 1, wherein the housing is formed from plastic materials.

11. A holder for holding a flexible sheet material in a generally vertical manner on a wall, said holder comprising:

(a) an elongated substantially horizontally oriented housing for mounting on the wall, said housing having an open sided interior longitudinal passageway extending the length of the elongated housing, further wherein the passageway has a front wall and a rear wall with said walls converging to form a narrowed opening sufficiently wide to receive an edge of the flexible sheet material; and (b) at least one wedging means positioned in the interior of the passageway of the elongated housing to hold the sheet material against one of the walls of the passageway, each said wedging means including (i) a cylindrical rod dimensioned to freely fit into the interior of the passageway but unable to pass through the narrowed opening of the passageway and further having approximately centered bore holes and (ii) a handle removably attached in the bore holes of the cylindrical rod and further said handle being capable of extending through the narrowed opening of the passageway for grasping so as to cause vertical movement of the cylindrical rod within the passageway to allow the sheet material to be received within the passageway and thereafter trap the sheet material against a wall.

12. The holder as defined in claim 11, wherein said housing further has an angled notch in a wall with the narrowed opening to permit controlled passage of each said wedging means using the attached handle through the notch into effective alignment relative to one another longitudinally spaced within said passageway.

13. The holder as defined in claim 11, wherein the housing comprises the internal passageway with only one angular convergent wall while maintaining space to utilize existing vertical surface for opposite wall.

14. The holder as defined in claim 11, wherein the housing is constructed of wood.

15. The holder as defined in claim 11, wherein the housing is formed from substantial plastic material.

16. The holder as defined in claim 11, wherein the housings' face is configured to provide the means to support an illuminating source.

* * * * *